US005193255A

United States Patent [19]

Tseng et al.

[11] Patent Number: 5,193,255

[45] Date of Patent: Mar. 16, 1993

[54] CLIP MEANS FOR FASTENING OF DECORATIVE LAMP PARTS

[76] Inventors: Jeou N. Tseng, No. 52-1, Alley 100, Lane 311 Nan Yea Street; Jeng-shyong Wu, Fl. 4, No. 5, Hsing Shyue Road, both of Hsin-Chu City, Taiwan

[21] Appl. No.: 771,426

[22] Filed: Oct. 4, 1991

[51] Int. Cl.[5] ..... A44B 17/00

[52] U.S. Cl. ..... 24/625; 24/336; 24/662

[58] Field of Search ..... 24/625, 626, 622, 623, 24/624, 617, 605, 662, 324, 336; 411/338, 339, 510, 512

[56] References Cited

U.S. PATENT DOCUMENTS

| | | | |
|---|---|---|---|
| 1,823,229 | 9/1931 | Balbaud | 24/662 |
| 2,709,290 | 5/1955 | Rosenthal | 411/512 |
| 2,716,701 | 8/1955 | Becker | 24/605 |
| 2,947,053 | 8/1960 | Sanderson | 24/662 |
| 3,107,409 | 10/1963 | Arthaud et al. | 24/662 |
| 3,120,971 | 2/1964 | Rengtsson | 24/625 |
| 3,225,922 | 12/1965 | Straight | 24/336 |
| 3,751,056 | 8/1973 | Wightman | 24/662 |

FOREIGN PATENT DOCUMENTS

| | | | |
|---|---|---|---|
| 0083978 | 5/1921 | Fed. Rep. of Germany | 24/625 |
| 2035735 | 4/1972 | Fed. Rep. of Germany | 24/662 |
| 0360591 | 4/1906 | France | 24/662 |
| 0996542 | 6/1965 | United Kingdom | 24/662 |

*Primary Examiner*—Victor N. Sakran

*Attorney, Agent, or Firm*—J. A. Drobile; R. E. Rosenthal

[57] ABSTRACT

Clip means for fastening of decorative lamp parts comprises a male (or caught) member having an enlarged head of spear or mushroom shape extending from a stem and a female (or catch) member constituted of a cavity like an aperture, a through-recess or a gap between a pair of bosses to take the male member wherein each catch or caught means may choose to respectively locate on or extend from a first part of the decorative lamp parts including lampshield, lamp base, lamp etc. to be conjugated with a second part of the decorative lamp parts complementary to and to be fastened to the said first part of the parts by clipping the caught or male member into the catch or female member. Said catch and caught means may be applied in singular set or disposed in double sets diametrically, catch and/or caught member may desirably made integrally with the first and/or second part where flange, extending stem etc. are made available. The disposition of the members may direct horizontally, vertically or angularly from any part of the lamp parts.

27 Claims, 8 Drawing Sheets

CLIP MEANS FOR FASTENING OF DECORATIVE LAMP PARTS

The present invention relates generally to clip means and more particularly to clip means for fastening decorative lamp parts.

A decorative lamp such as Christmas lights comprises usually the following parts including lamp bulb, lamp base, lamp holder even lamp shield. Fastenings between adjacent parts are called for wherever falling-apart due to the loose connection between parts tends to occur.

Peg and hole pair is most commonly seen snap together means, however, occasions of slip-out are frequently experienced due to no positive securing element is provided thereon.

fastening means having simple structure and easy-to-apply in nature are of course essential pre-requisites, however, a sure enough detaining effect should count as even more desirable.

Therefore the main object of the present invention is to provide a fastening means in the form of clip-together members yet with securing element provided self-containedly to one of the members to ensure reliability of the fastening.

Another object of the present invention is to provide a fastening means of clip-together type which is composed of a catch member or female member and a caught member or male member. The fastening function is performed through the clipping of the male member which generally including a wholesome or split spear head or mushroom head into a female member which constitutes an aperture, a concave through-recess or a gap between a pair of spaced bosses, and be detained therein.

A further object of the present invention is to provide a clip mean for fastening of lamp parts wherein each catch or caught means may choose to respectively locate on or extend from a first part of the parts to be fastened to a second part thereof.

A still further object of the present invention is to provide a catch and caught type clip means for fastening which may be applied in singular set or diametrically disposed double sets, wherein the disposition of the members may direct horizontally, vertically or angularly from any part of the lamp parts with the aid of extension stem, flange means etc.

Other objects and features of the present invention will become apparent with detailed description of accompanying drawings, of which:

FIGS. 1(A)–(C) are schematic drawings showing three alternatives of the catch or female members of the clip means of the present invention;

FIGS. 2(A), (B) are schematic diagrams showing two alternatives of the caught or male members of the clip means of the present invention;

FIGS. 3 to 9 depict the examples of application embodying the present invention, wherein:

Figure 4A:
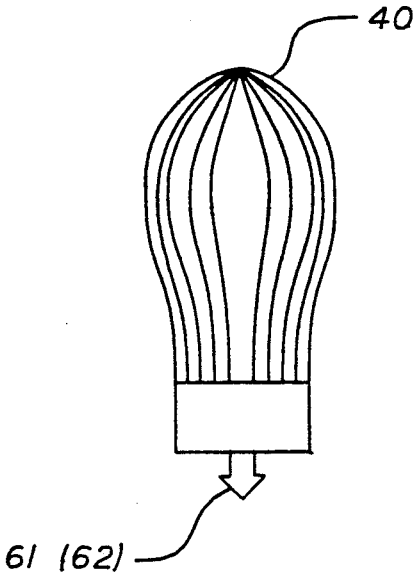
Figure 4A:
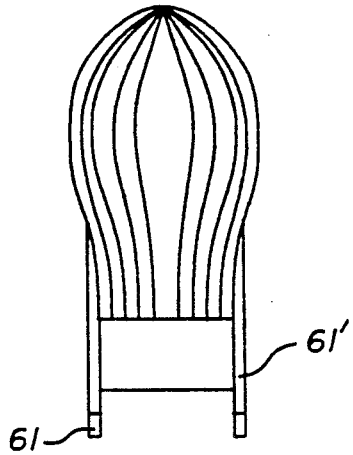
Figure 4A:
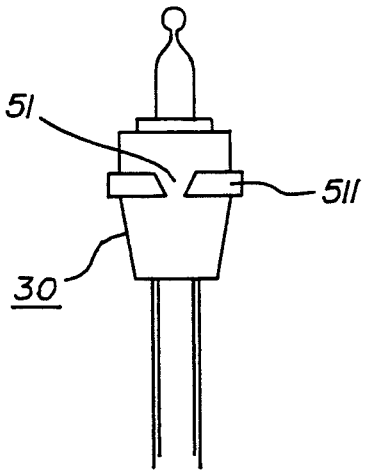
Figure 4B:
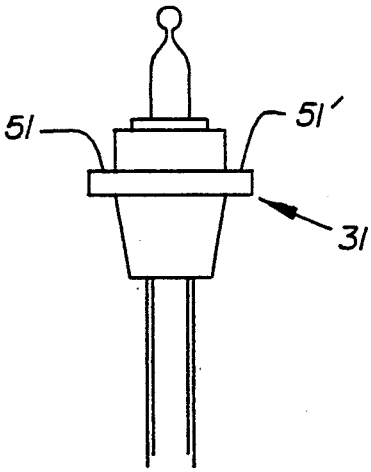
Figure 5A:
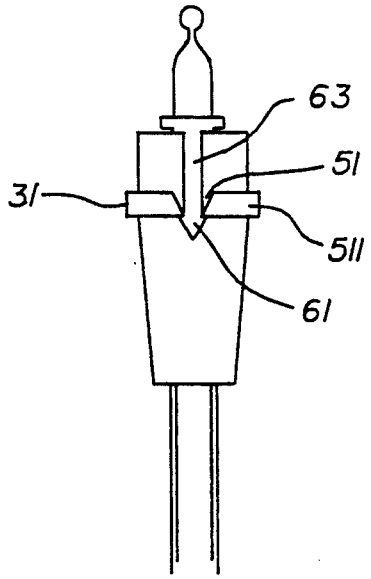
Figure 5B:
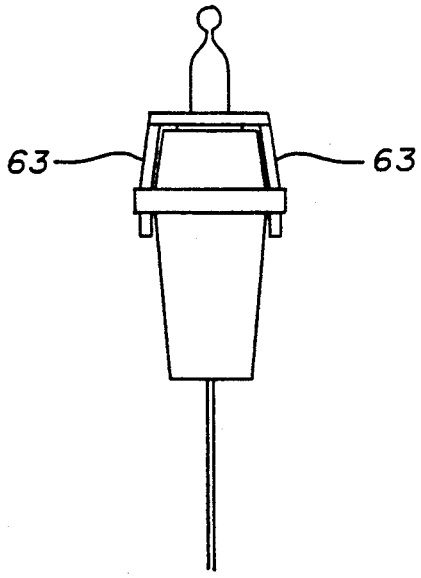
Figure 6:
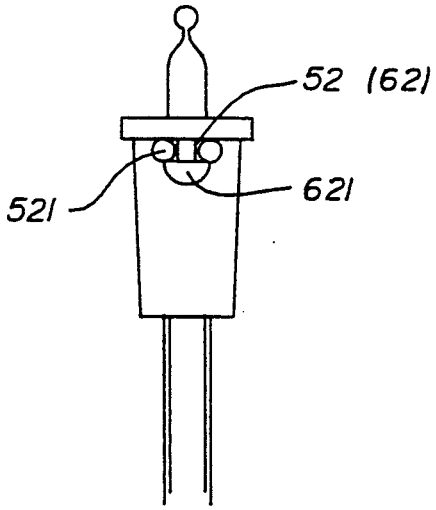
Figure 7A:
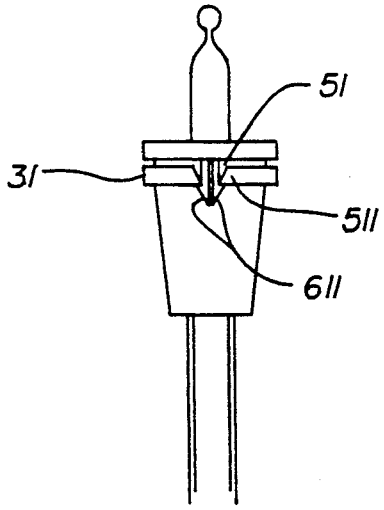
Figure 7B:
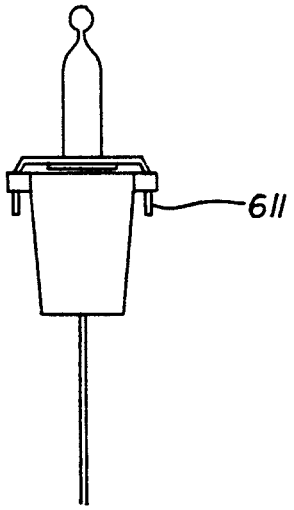
Figure 8A:
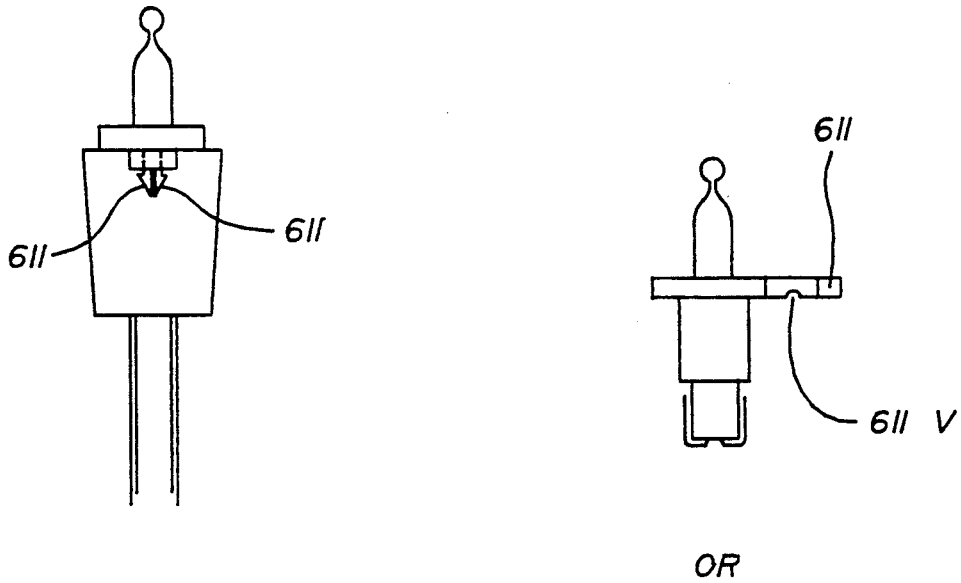
Figure 8B:
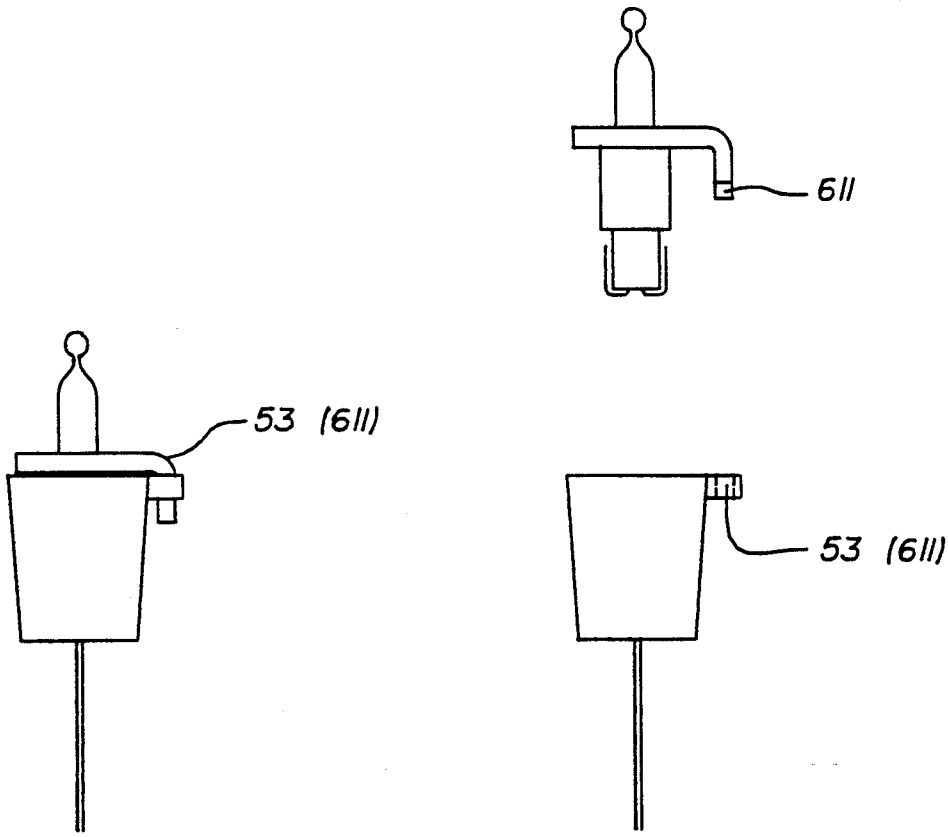
Figure 9A:
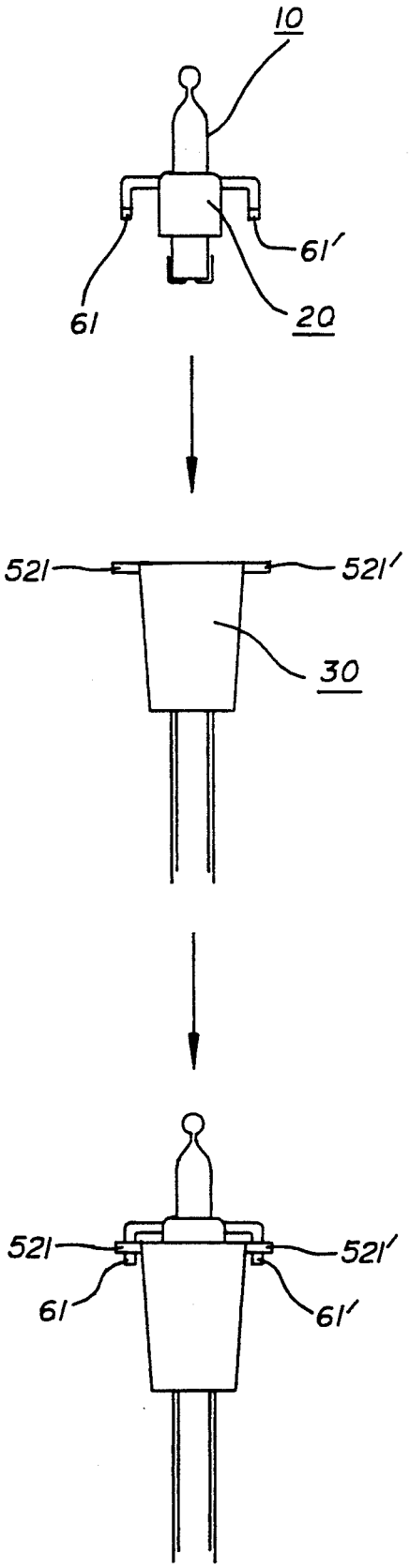
Figure 9B:
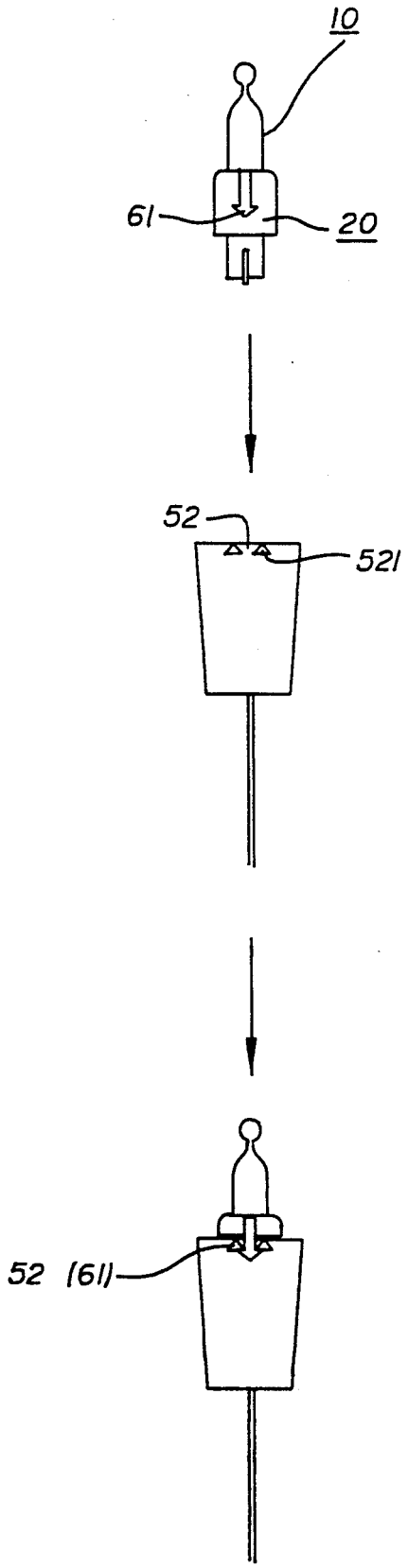

FIG. 4(A) a front view of an Example 2 showing a pair of spearheads on a lamp shield and recesses on lamp holder; and FIG. 4(B), the side view thereof;

FIG. 5(A), a front view, depicts an Example 3, showing an assembled lamp with downwardly extended spearhead(s) as caught member(s) provided upon lamp base and a recessed catch member on the lamp holder, and FIG. 5(B), a side view thereof;

FIG. 6 is a front elevation of an Example 4 wherein a pair of bosses is shown as catch member for a mushroom headed caught member;

FIG. 7(A) is a front view of an Example 5 wherein a pair of split spear on a lampbase is caught by a recess on lamp holder, and FIG. 7(B), a side view thereof;

FIG. 8(A) is a front elevation of Example 6, a split spear on lamp base is seem caught in an aperture on a lamp holder, and FIG. 8(B) its side view showing steps of assembling, FIG. 9(A) depicts a front elevation of an Example 7 showing the assembling steps of a spear-head provided lamp base with a gap formed by a pair of triangular shaped bosses; and FIG. 9(B), the side view thereof.

Figure 1A:
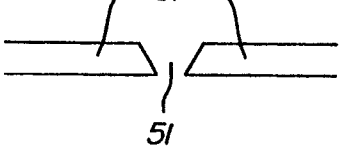
Figure 1B:
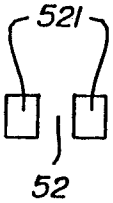

Now referring to FIGS. 1(A) and 1(B), the clip means for the fastening of adjacent parts of a decorative lamp which may consist of a lamp bulb (10), a lamp base (20), a lamp holder (30) even a lamp shield (40), the clip means is composed of a male or caught member (60) and a female or catch member (50). The cooperation of the two constitutes a sure grip there-between.

FIG. 1 shows three alternatives of catch or female member (5) including:

In FIG. 1(A), a recess type catch (51) which is a concave through-recess disposed on a flange (21) or (31) respectively on a lamp base (20) or a lamp holder (30) constituting a part thereof. The recess is formed between a pair of broken sections (511—511) of the flange.

Figure 1C:
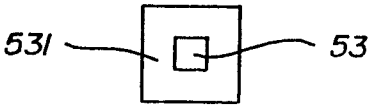

In FIG. 1(B), a gap type catch (52) formed between a raised boss pair (521—521), cross-section of each boss can be round, triangle, square whatever geometric from in shape, here is shown in FIG. 1(B), a round cross section boss; and In FIG. 1(C), an aperture type catch (53) which is substantially an opening surrounded by a solid closure (531), the opening may be of any shape of cross-section, so far as it is capable of let entering of a caught or male member and have the head part detained therein. Said solid closure can be formed as an integral part to the lamp base (20) or lamp holder (30) where fastening of the part is called for.

Figure 2A:
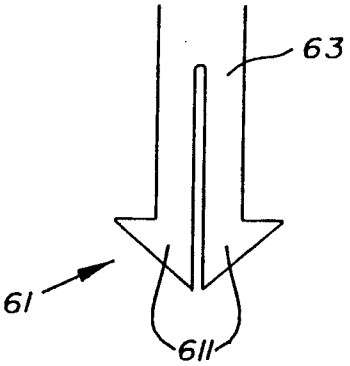
Figure 2B:
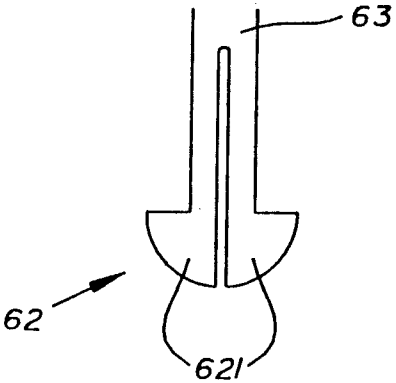
Figure 3A:
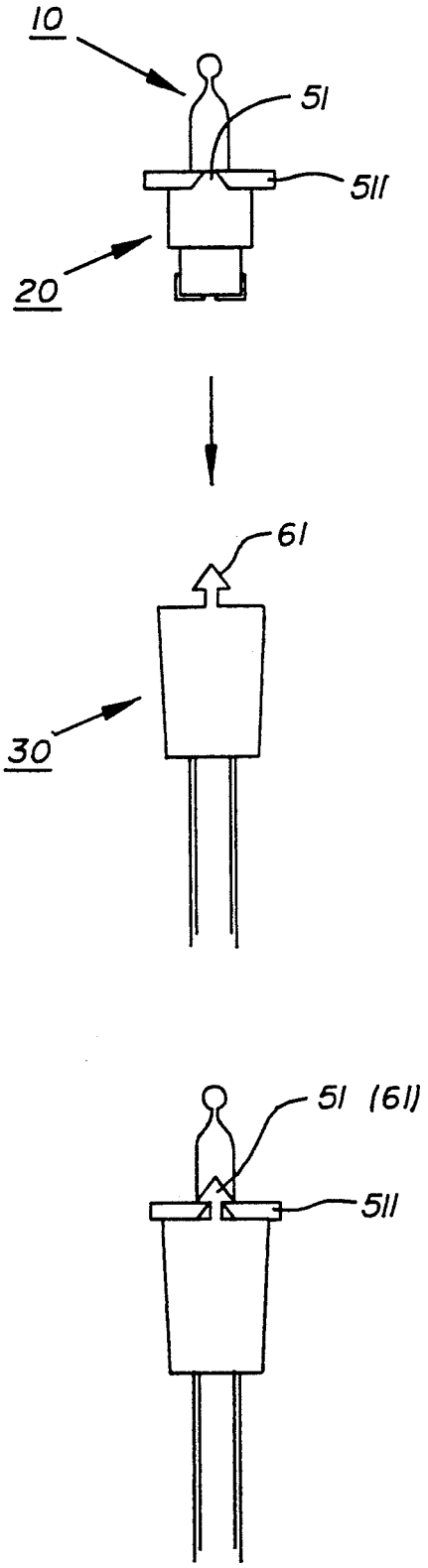
FIG. 3(A) depicts a front elevation of an Example 1 embodying the present invention showing a spearhead caught member on lamp holder and a through-recess catch member on lamp base, and FIG. 3(B), the side view thereof.
Figure 3B:
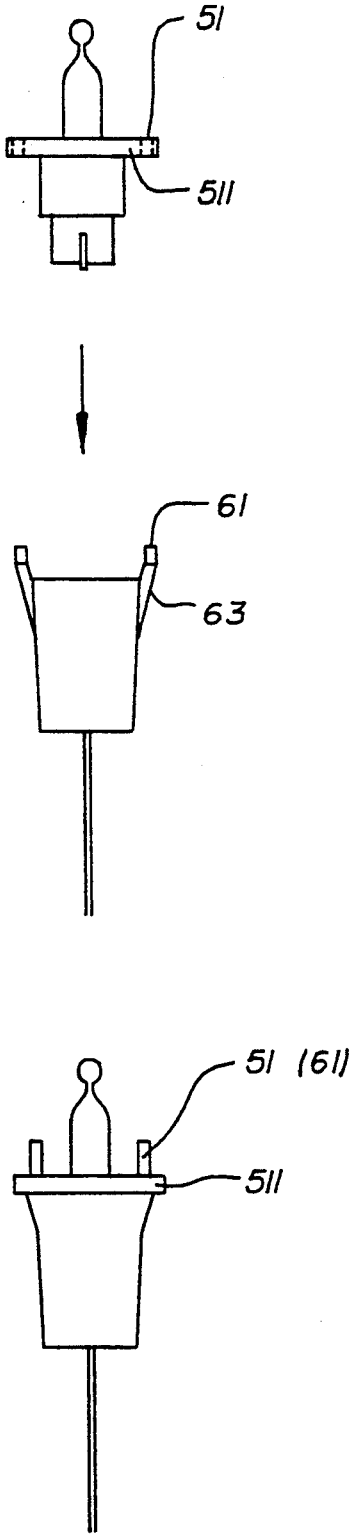

FIG. 2 shows two forms of caught or male member (60) including: in FIG. 2(A), a spear type caught (61) and in FIG. 2(B), a mushroom type caught (62) each with an extension stem (63) connected respectively to a spear or mushroom shaped head (61,62). Head (61,62) may be a whole piece or each split into two halves (611—611, 621—621). The splitting provides the head portion with additional flexibility to the caught members (61,62) which are of themselves elastic materials.

The spear head or mushroom head is so shaped and constructed as to facilitate entering the through-recess, the gap, and the aperture of the catch means and be detained therein with embulged head.

The stem (63) can be made integrally with any desired part of the lamp parts or adhered to rims, flanges etc. thereof and extended at any angle, preferably angles $>90$ therefrom.

The abovesaid catch/caught pair may be arbitrarily matched such as in: through-recess/spear pair (51/61), recess/mushroom pair (51/62), aperture/split mushroom pair (53/621), etc.

In application, single pair or diametrically disposed double pairs are at option.

Now referring to FIGS. 3 to 9 for examples of application 1-7 embodying the present invention.

Example 1 (FIGS. 3A, 3B) having a recess/spear match (51/61) wherein the spear (61) is disposed at the upper rim of a lamp holder (30) and formed integral thereupon. The stem (63) extended upwardly therefrom at an angle >90 with said rim of the holder, the through-recess 51 to retain the spear (51) is formed by two taper faced broken sections (511—511) on the flange (21) of the lamp base (20). The match (51/61) are in diametrically disposed double pairs as clearly indicated in FIG. 3(B).

This Example 1 is served for the convection between a lamp base (20) and a lamp holder (30).

Example 2 (FIGS. 4A and 4B) is for the connection of a lamp shield (40) and a lamp holder (300, the clip means selected is of a spear/recess pair (51/61).

A diametrically disposed double pairs of 51/61 match are seen with the through recesses (61) formed by broken sections (511—511) as a pair of flange (31) around the periphery of the lamp holder (30), and the spear (61) is extended straight-downwardly from under the rim of the lamp shield (40). As mentioned in the Example 1, the recess may be composed of an opposite taper faced pair (511—511).

Example 3 (FIGS. 5A and 5B) is also a recess/spear match (51/61), for the connection of a lamp base (2) having a rim of flange 21, upon which the spear shaped caught members are seen disposed diametrically and depended thereupon and extended downwardly at an angle > or =90.

The recess (51) to retain the spear (61) is formed by broken sections (511—511) of a flange (31) disposed peripherically around the waist of the holder (3). The catch/caught pair of course may be optionally a single pair, and opposite faces (511—511) are tapered as usual.

Example 4 (FIG. 6) shows a match of gap (52) formed between two bosses (521—521) each of round cross-section and a mushroom (62).

The bosses (521) are disposed adjacent the upper rim of a lamp holder (30) while the mushroom head (62) extends downwardly from an oversized flange (21) of a lamp base (20) which is buried in the holder (30) and not seen. Thus the match pair (52/62) is formed, however, the bosses may be of other choices of the shape of the cross-section, triangular, square, etc. optionally. A single boss detainer instead of the gap between two bosses may even be considered if feasible.

Example 5 (FIGS. 7A and 7B) depicts a connection between a lamp base (20), appears only its flanged upper rim (21) and a lamp holder (30) with its upper rim flange (31) broken into sections (511—511). The clip means in this embodiment constitutes a split spear head in halves (621—621) extended downwardly from an oversized flange (21) with the stems of the spear bent in angle >90 then have the split spear halves (621—621) retained in the recess (51) formed between broken sections (511—511). Other than split halves (621—621) the spear can be a wholesome one (62) instead.

Diametrically disposed double match pairs (51/621) are seen in FIG. 7B, which can also be a single pair.

Example 6 (FIGS. 8A and 8B) shows an aperture/-split spear match (53/611) with a single pair of clip means provided at one side of the lamp base-lamp holder connection. The caught member of split spear (611—611) is seen in FIG. 8(B) with its stem (63) extended horizontally from and made integrally on the upper rim flange (21). A notch (611V) is cut along the stem (63) enabling to be bent downward into a right angle so that the spear head (611—611) can be inserted into the aperture (53) provided on enclosing lug (531) projecting horizontally from the upper rim of the lamp holder (30).

The caught member (611—611) can also be a whole piece member (61).

Example 7 (FIGS. 9A and 9B) provides a couple of gap/spear matches (52/61) between a lamp holder (30) and a lamp base (20) which is cleared from any flange or rim. The bosses (521) forming the gap (52) is seen in FIG. 9B in triangular cross-section, yet they can be of any geometric shapes, round as usual and square, etc., otherwise.

The caught member is shown in spear shape (61), of course can also be mushroom (62). The clip means can be in single or diametrically disposed double pairs.

A component list is hereunder attached for easy references.

COMPONENT LIST

10 Bulb
20 lamp base
  21 flange
30 lamp holder
  31 flange
40 lamp shield
50 catch (female) member
  51 recess type
  511 flange halves
  52 gap type
  521 boss
  53 aperture type
  531 lug
60 caught (male) member
  61 spear type
  611 halves
  62 mushroom type
  621 halves
  63 extension stem

We claim:

1. A decorative lamp for Christmas lights, comprising:

a lamp base, having a flange about an upper rim thereof;

a lamp holder having a flange; and clip means comprising a male or caught member having a bulged head disposed on a stem located on one of said lamp base and said lamp holder, and a female or catch member defining a cavity serving as a retainer located on another one of said lamp base and said lamp holder, said clip means being so disposed that, upon fastening, the male or caught member is clipped into the female or catch member and is retained therein and said lamp base is seated in said lamp holder.

2. The decorative lamp according to claim 1, wherein the bulged head of said first male or caught member is in the form of a spear, and is in a solid form.

3. The decorative lamp according to claim 1, wherein the stem of the male or caught member is made integrally to a rim on said one of said lamp base and said lamp holder, to extend toward any direction at a desired angle.

4. The decorative lamp according to claim 3, wherein the stem is cut with a notch to facilitate the bending of the stem to a desired angle so that the bulged head of the male or caught member can align with the female or catch member and to be clipped in.

5. The decorative lamp according to claim 1, wherein the cavity in the female or catch member is a through-recess formed by a pair of taper faced broken section of a flange portion provided on one of the parts to be fastened.

6. The decorative lamp according to claim 1, wherein the cavity in the female or catch member is a gap formed between a pair of bosses.

7. The decorative lamp according to claim 6, wherein each boss in the boss-pair has a triangular cross-section.

8. The decorative lamp according to claim 6, wherein each boss in the boss-pair has a square cross-section.

9. The decorative lamp according to claim 6, wherein the boss in the boss-pair is circular in cross-section.

10. The decorative lamp according to claim 6, wherein one of the boss in the boss-pair is eliminated.

11. The decorative lamp according to claim 1, wherein the cavity in the female or catch member is an aperture, formed in a lug of surrounding walls projected from a rim, a specifically provided flange of one of the parts to be fastened.

12. The decorative lamp according to claim 1, wherein the male/female or caught/catch member pair is provided as a single pair.

13. The decorative lamp according to claim 1, wherein the bulged head of said male or caught member is in the form of a spear, and is split into two halves, a channel being defined between said two halves.

14. The decorative lamp according to claim 1, wherein the bulged head of said male or caught member is in the form of a mushroom, and the head is in a solid form.

15. The decorative lamp according to claim 1, wherein the bulged head of said male or caught member is in the form of a mushroom, and the head is split into two halves, a channel being defined between said halves.

16. The clip means according to claim 1, wherein the one of lamp base and lamp holder on which said male or caught member is disposed comprises a flange protruding therefrom, said stem of said male or caught member being made integrally with said flange, to extend toward any direction at a desired angle.

17. The decorative lamp according to claim 1, further comprising a second male member and a second female member constituting a pair, wherein, upon fastening, said second male member is clipped into and retained in said second female member, said second male member and second female member pair being disposed on said lamp diametrically opposite said male/female pair.

18. A decorative lamp for Christmas lights, comprising:

a lamp base, having an outwardly-projecting upper rim;

a lamp holder having a flange, said lamp base being seated in said lamp holder;

a lamp shield; and clip means comprising a male or caught member having a bulged head disposed on a stem located on one of said lamp holder and said lamp shield, and a female or catch member defining a cavity serving as a retainer, located on the other one of said lamp holder and said lamp shield, wherein upon fastening, the male or caught member is clipped into the female or catch member and is retained therein and said lamp shield is fastened to said lamp holder.

19. The decorative lamp according to claim 18, wherein the bulged head of said male or caught member is in the form of a spear and has a solid form.

20. The decorative lamp according to claim 18, wherein the stem of the male or caught member is made integrally to said flange of said lamp holder.

21. The decorative lamp according to claim 20, wherein the stem is cut to define a notch therein to facilitate the bending of the stem to a desired angle so that the bulged head of the male or caught member can align with the female or catch member.

22. The decorative lamp according to claim 18, wherein the cavity in the female or catch member is a through-recess formed by a pair of taper-faced broken sections of a flange portion provided on one of the parts to be fastened.

23. The decorative lamp according to claim 18, wherein the cavity in the female or catch member is a gap formed between a pair of bosses.

24. The decorative lamp according to claim 23, wherein each boss of the boss-pair has a circular cross-section.

25. The decorative lamp according to claim 18, wherein the female member comprises one and only one boss.

26. The decorative lamp according to claim 18, wherein the cavity in the female or catch member is an aperture, formed in a lug of surrounding walls projected from a rim, on one of the parts to be fastened.

27. The decorative lamp according to claim 18, further comprising a second male/female pair disposed on said lamp diametrically opposite from said male member and said female member.

* * * * *